US008561259B2

(12) United States Patent
Liao

(10) Patent No.: US 8,561,259 B2
(45) Date of Patent: Oct. 22, 2013

(54) DAMPENING HINGE

(76) Inventor: Tianming Liao, Foshan (CN)

( * ) Notice: Subject to any disclaimer, the term of this patent is extended or adjusted under 35 U.S.C. 154(b) by 225 days.

(21) Appl. No.: 12/979,446

(22) Filed: Dec. 28, 2010

(65) Prior Publication Data

US 2011/0154609 A1 Jun. 30, 2011

(30) Foreign Application Priority Data

Dec. 28, 2009 (CN) ..... 2009 2 0265714

(51) Int. Cl.
*E05F 3/20* (2006.01)

(52) U.S. Cl.
USPC ..... 16/54; 16/68; 16/286

(58) Field of Classification Search
USPC ..... 16/286–288, 54, 66, 68, 50, 82, 84, 16/294, 370; 188/290, 322.5
See application file for complete search history.

(56) References Cited

U.S. PATENT DOCUMENTS

| | | | | |
|---|---|---|---|---|
| 4,449,269 | A * | 5/1984 | Sundermeier et al. | 16/50 |
| 5,269,043 | A * | 12/1993 | Yang | 16/68 |
| 6,591,454 | B2 * | 7/2003 | Brustle | 16/374 |
| 6,859,979 | B2 * | 3/2005 | Egger et al. | 16/327 |
| 7,275,284 | B2 * | 10/2007 | Lautenschlager et al. | 16/287 |
| 7,669,285 | B2 * | 3/2010 | Gallasch et al. | 16/286 |
| 7,712,185 | B2 * | 5/2010 | Pyo | 16/286 |
| 7,900,321 | B2 * | 3/2011 | Fitz et al. | 16/362 |
| 7,966,696 | B2 * | 6/2011 | Krammer | 16/286 |
| 8,205,298 | B2 * | 6/2012 | Lin et al. | 16/287 |

* cited by examiner

*Primary Examiner* — William Miller
(74) *Attorney, Agent, or Firm* — MDIP LLC

(57) ABSTRACT

A dampening hinge for example, for furniture, having a hinge cup with a U-shaped pin, a connecting arm and a hinge base, where one end of the connecting arm is attached to the upper arm of a U-shaped pin and the other end of the connecting arm is attached to the hinge base, the lower arm of the U-shaped pin is attached to a pull rod of a damper mounted on the hinge base by means of a hinge arm module; the hinge arm module includes a swinging arm and a movable swinging arm, where the middle portion of the swinging arm is attached to the hinge base, one end of the swinging arm is hinged with the lower arm of the U-shaped pin and the other end of the swinging arm is hinged with the movable swinging arm, the movable swinging arm is further connected to the pull rod of the dampener and the hinge base, is described.

9 Claims, 3 Drawing Sheets

DAMPENING HINGE

The present application claims priority to China Ser. No. 200920265714.X filed 28 Dec. 2009 titled, "A DAMPENING HINGE FOR FURNITURE."

FIELD

The present disclosure relates to a dampening hinge, and in some embodiments, for use in, for example, furniture.

BACKGROUND

Dampening technology has been used widely in the field of furniture hinges to obtain smoother door opening and closing as well as preventing doors from slamming caused by excessive forces restoring the door to the closed position. Thus, furniture products with dampening hinges are favored by consumers.

A common dampening hinge comprises a hinge cup, a connecting arm and a hinge base, which are hinged or connected together in sequence. The hinge cup further is attached to a pull rod of a damper mounted on the hinge base by a hinge arm, and the hinge cup is driven by an outer force to achieve a braked opening/closing movement on the hinge base.

A hinge adopting a sector gear for transmission, for example, disclosed in CN Pat. No. ZL200720047410.7, comprises an inner swinging arm and a connecting element, wherein both the inner swinging arm and the connecting element are related to a sector gear and adopt gear engagement for transmission. However, that device has disadvantages. For example, the sector gear is made of thin metal and the transmission gear is small. Hence, the thin and small gears stick under use; an inflexibility of opening and closing occurs; and gears can collapse. Such disadvantages reduce product lifespan and widespread use. Moreover, machining the transmission gear and the thin and small inner swinging arm, and then connecting the components, increase manufacturing complexity and cost.

SUMMARY

Objects of the present disclosure include overcoming the foregoing shortcomings of the prior art by providing a dampening hinge for, for example, furniture, with longer lifespan, a simplified structure and reduced manufacturing cost.

Those and other objects were attained in the development of a dampening hinge, such as, for furniture, comprising a hinge cup, a connecting arm and a hinge base, which are hinged together or connected in sequence, wherein, said hinge cup comprises a bifunctional securing device, such as, a U-shaped pin, with suitably placed pin receiving holes or voids, one end of said connecting arm is attached to an upper arm of said U-shaped pin and the other end of said connecting arm is attached to said hinge base, for example, by a front bottom pin. A torsion spring is mounted on said hinge base by said front bottom pin, one free end of said torsion spring bears on the upper arm of said U-shaped pin and the other free end of said torsion spring bears on said hinge base to urge closing of the hinge cup and the hinge base, that is, urging the close approximation of the cup and the base. That action, in the context of a door and a cabinet or frame, brings the door in close approximation to a face of the cabinet, that is, that action urges closing of the door. The lower arm of said U-shaped pin is attached to a pull rod of a damper mounted on said hinge base by means of a hinge arm module. The opening and closing motion or movement of the hinge cup relative to the hinge base is triggered by an outer or external force. The damper counteracts the urging of the torsion spring. Thus, the damper dampens or slows the approximation of the cup and the hinge. That action in the context of a door and a cabinet or frame slows the closing action of the door.

Said hinge arm module comprises a swinging arm and a movable swinging arm, wherein, the middle portion of said swinging arm is attached to a pivoting securing device, such as, a pin, mounted on said hinge base, one end of said swinging arm is hinged with the lower arm of said U-shaped pin and the other end of said swinging arm is hinged, for example, with a pin and an accommodating swinging arm connecting hole on said movable swinging arm. A securing device, such as, a damper connecting hole provided by said movable swinging arm is used to connect said pull rod of said damper to said movable swinging arm. Said movable swinging arm is movably connected, for example, by a pin fixed on said hinge base with a suitable pin-receiving base connecting hole. Said swinging arm connecting hole is positioned on one side of said base connecting hole, and said damper connecting hole is positioned on the other side of said base connecting hole.

In embodiments, said swinging arm connecting hole, said base connecting hole and said damper connecting hole are configured in an inverted triangular arrangement in which said swinging arm connecting hole and said damper connecting hole are situated above said base connecting hole. Alternatively, said swinging arm connecting hole, said base connecting hole and said damper connecting hole can be configured in line.

In embodiments, the base connecting hole is shaped as an ellipse. Alternatively, said base connecting hole can be an elongated hole.

In embodiments, the movable swinging arm has a U-shaped configuration and clamps or connects the swinging arm and the pull rod of the damper.

In embodiments, the damper can comprise an air dampening cylinder or a hydraulic dampening cylinder.

By comparison with the current technology, the present disclosure provides an advantageous dampening hinge that can be used for and with, for example, furniture, wherein a hinge arm module has a cooperative configuration of a swinging arm and a movable swinging arm, in which two swinging arms are connected to transmit a dampening force. That modification over the prior art changes the conventional configuration of hinge arms of a sector gear transmission to a configuration of two swinging arms to minimize sticking of the hinge arm module during the transmission process. The new configuration also provides a product with a longer lifespan. Moreover, the hinge arm module of interest removes the need to manufacture a sector gear. That optimizes the structure of the hinge and simplifies the structure of the hinge arm thereby lowering manufacturing cost and improving competitiveness of the product in the market.

BRIEF DESCRIPTION OF THE FIGURES

The following description of the figures and the respective drawings are non-limiting examples that depict various embodiments that exemplify the present disclosure.

DETAILED DESCRIPTION

Figure 1:
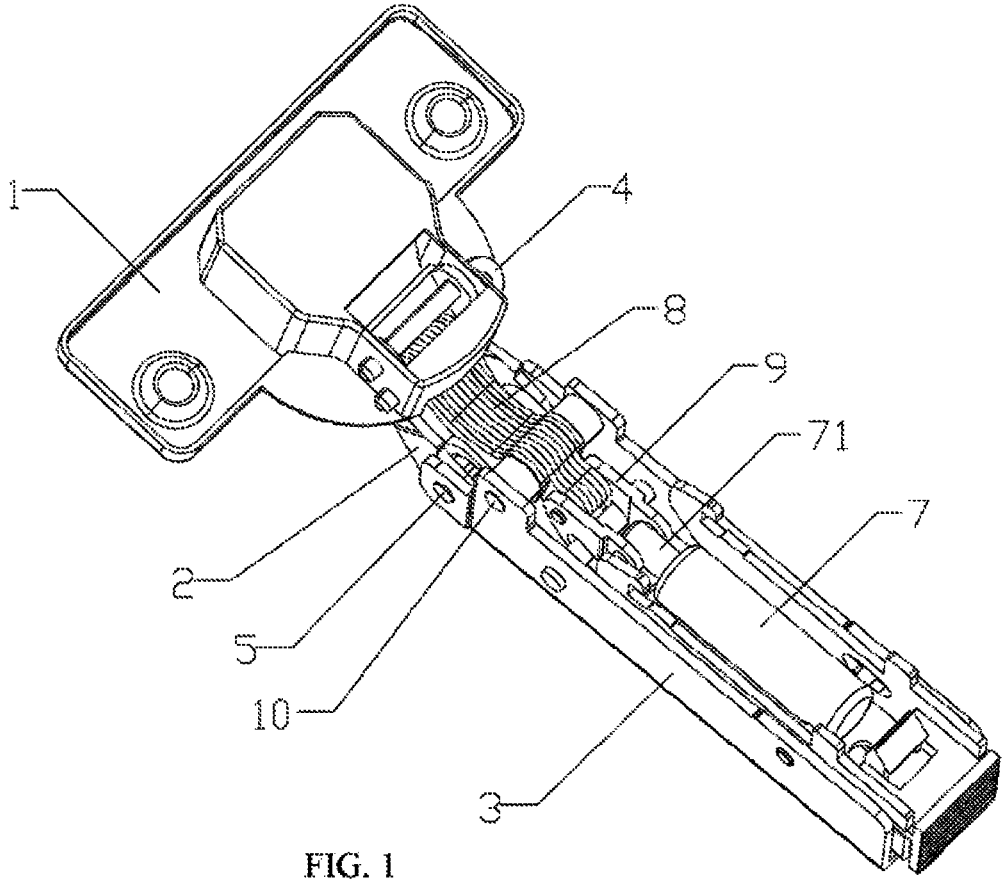
FIG. 1 is a schematic diagram illustrating the structure of a hinge cup in the open position in an embodiment of the present disclosure.
Figure 2:
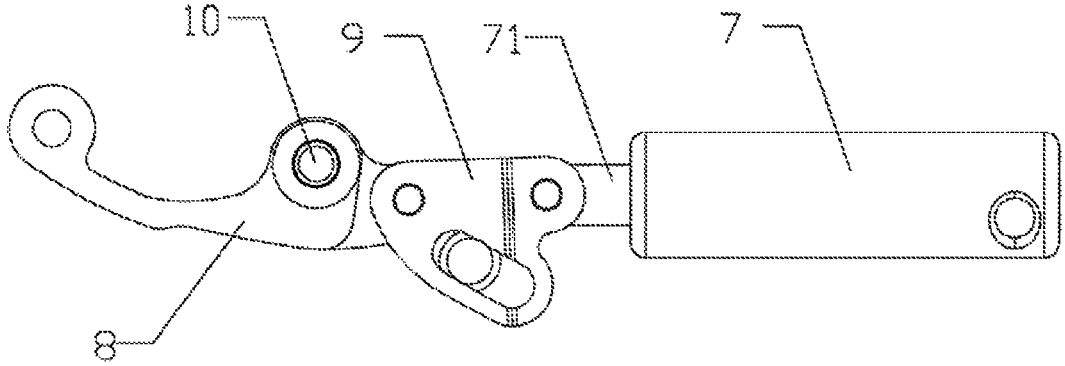
FIG. 2 is a schematic diagram illustrating connectivity between the hinge arm module and the damper when the hinge cup is in the open position in an embodiment of the present disclosure.
Figure 3:
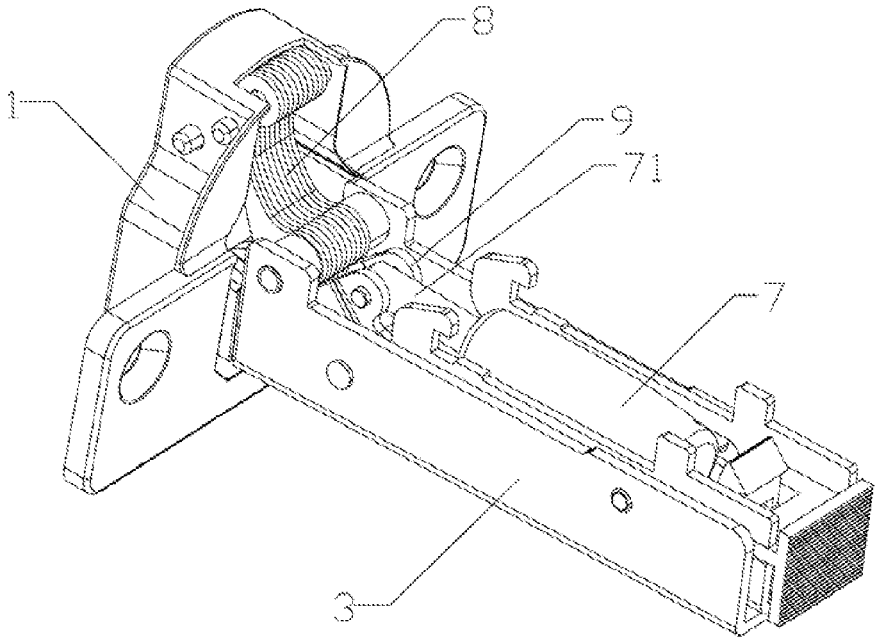
FIG. 3 is a schematic diagram illustrating the structure of a hinge cup in the closed position in an embodiment of the present disclosure.
Figure 4:
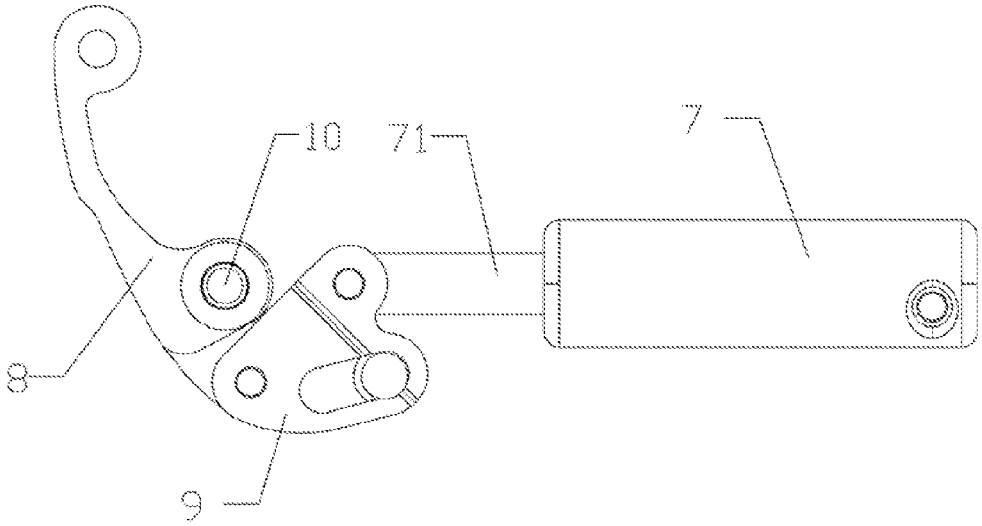
FIG. 4 is a schematic diagram illustrating connectivity between a hinge arm module and a damper when the hinge cup is in the closed position in an embodiment of the present disclosure.
Figure 5:
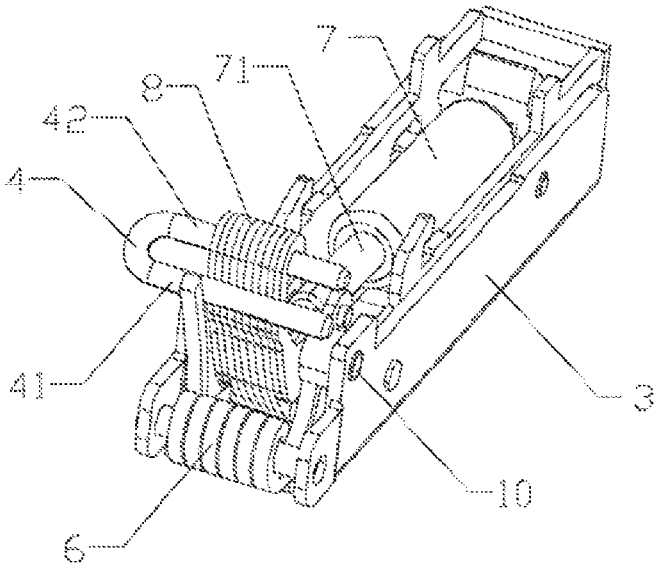
FIG. 5 is a schematic diagram illustrating a hinge arm module, a damper and a hinge base in an embodiment of the present disclosure.

Although, for example, the accompanying drawings depict and some of the teachings herein relate to a furniture cabinet and door, the dampening hinge of interest can be used in a number of embodiments and the uses disclosed herein with regard to furniture are to be understood as exemplifications and not limitations of the full use of a dampening hinge of interest.

The words, "dampen" and "damp," and grammatic forms thereof, are used interchangeably herein.

The device of interest can be configured of any known material that is suitable for use as a hinge, such as, a metal or an alloy.

The various portions of a device of interest can be attached or secured by devices known in the art and suitable for use as described herein. Hence, where joined portions are intended to move, pivot and the like, those portions can be secured, for example, by a pin that traverses and attaches one part to another, each part comprising a pin guide, housing, such as, a hole or void, to accept and to accommodate such a pin, the pin securing the two parts while allowing the parts to move, rotate, pivot and the like about the axis defined by the pin. Other securing or joining devices can be used as known in the art, some of which may be one that secures parts together where the parts need not be movable or pivoting, such as, a rivet or a screw. For the purposes of the disclosure, parts that are operatively linked are those that are connected as known in the art, using a connecting device as known in the art to produce parts that move or pivot, as needed for the hinge of interest, or to produce parts that need not or should not move relative to each other. Hence, two movable or pivoting parts that are operatively linked may be joined by a pin, and two immovable parts that are operatively linked may be welded together or joined by a rivet or a screw.

Referring to FIG. 1 to FIG. 6, a dampening hinge of interest comprises a hinge cup, 1, a connecting arm, 2, and a hinge base, 3, which are hinged or joined together in sequence. The hinge base, 3, generally can consist of an outside base and an inside base. The hinge cup, 1, can be mounted on a movable structure, which can have an open posture and a closed posture, wherein when closed, said movable structure is seated in or is flush with a larger structure in which the movable structure forms a wall, side, face or portion thereof of the larger structure, for example, the cup is mounted on the door of a cabinet. The hinge base, 3, can be mounted on the inner side wall of the larger structure to which the movable structure integrates and fits, such as, in the example of a door, the base is mounted on an inner side of a wall of a cabinet, for example, by means of a mounting base or bracket (not shown in the figures). The hinge cup and the hinge base can be provided in the opposite presentation, that is, in the example herein, the hinge cup can be attached to the larger structure, such as, the inner wall of a cabinet, and the hinge base can be attached to the movable structure, that is, to a door of the cabinet.

In an embodiment, the hinge cup can comprise a bifunctional attachment device, such as, a U-shaped pin, 4, which has an upper arm, 41, and a lower arm, 42, transversely penetrating the side walls of the hinge cup, 1, and fixed therein by way of accommodating pin receiving holes or voids.

The front end of the connecting arm, 2, extends into the inner cavity of the hinge cup, 1, and connects to the upper arm, 41, of the bifunctional attachment device, such as, in the example discussed herein, the U-shaped pin, 4. The other end of the connecting arm, 2, is attached to the hinge base, 3, for example, by a front bottom pin, 5.

The front bottom pin, 5, is fixed on the hinge base, 3, and penetrates a torsion spring, 6, wherein one free end of the torsion spring, 6, bears, in the example discussed herein, on the upper arm, 41, of the U-shaped pin, 4, and the other free end bears on the hinge base, 3.

When the hinge cup, 1, is triggered to close by an outer or external force, the stretched torsion spring, 6, generates a restoring force which is applied on the hinge cup, 1, urging and facilitating the hinge cup, 1, to close or to return to the closed position by reducing the stretch or strain on the torsion spring.

In the exemplification discussed herein, the lower arm, 42, of the U-shaped pin, 4, is connected to the pull rod, 71, of a damper, 7, mounted in the hinge base, 3, by means of a hinge arm module. The tail of the damping device, 7, is connected to the hinge base, 3, for example, by a pin, and the damper, 7, may rotate about that pin. The damper, 7, may be, for example, an air damping cylinder or a hydraulic damping cylinder.

Driven by an outer or external force, such as, one to open the movable structure, for example, a door, the hinge cup, 1, achieves an opening-closing motion relative to the hinge base, 3. When the hinge cup, 1, is fully opened, the hinge arm module goes into a "dead point" position, where the hinge arm module and the direction of the restoring force generated by the torsion spring, 6, are substantially in a straight line. In that position, the torsion spring, 6, remains in tension and the hinge cup, 1, remains open and immobile. When an outer or closing force is applied to the movable structure, and hence, on the hinge cup to break the balance, in other words, the direction of the restoring force generated by the torsion spring, 6, is no longer in a straight line with the direction of the hinge arm module, driven by the restoring force generated by the torsion spring, 6, the hinge cup, 1, moves to or toward the closed position. Meanwhile, the damper, 7, generates a dampening force against the motion of the hinge cup, 1, to dampen the movement of the movable structure, and hence, of the hinge cup, and in the example, the door, toward, the frame or cabinet, and preventing the hinge cup, 1, from moving too fast, which may result in a clash or a slam between the cabinet door and frame. Thus, the damper counteracts or slows the restoring force and action of the torsion spring.

In an embodiment, the hinge arm module comprises a swinging arm, 8, and a movable swinging arm, 9, wherein the swinging arm, 8, can have a laminated construction. The middle portion of the swinging arm, 8, is attached to an upper portion of the hinge base, 3, for example, by a pivot pin, 10. One end of the swinging arm, 8, is hinged, in the example herein, with the lower arm, 42, of the U-shaped pin, 4, and the other end of the swinging arm, 8, is movably or pivotly hinged, for example, with a pin a swinging arm connecting hole, 91, provided in the movable swinging arm, 9.

It should be understood that, as used herein, the phrase, "middle portion," not only refers to the middle portion of the connecting arm, 2, but the phrase substantially refers to the segment between the end of the swinging arm, 8, to which, in the instant example, the lower arm, 42, of the U-shaped pin is attached and the other end of the swinging arm, 8, to which the movable swinging arm, 9, is hinged. Additionally, the pull rod, 71, of the damper, 7, is pivotly attached to the movable swinging arm, 9, for example, by a damper connecting hole, 92, on the movable swinging arm, 9. The movable swinging arm, 9, is further movably connected to the hinge base, 3, for example, by a pin and a base connecting hole, 93, thereof.

Said movable swinging arm, 9, may have a U-shaped configuration and clamps or connects the swinging arm, 8, and the pull rod, 71, of the damper, 7. That configuration can ensure the swinging arm, 8, and the pull rod, 71, of the damper, 7, bear the applied forces more equitably, equally or sharedly.

Figure 6:
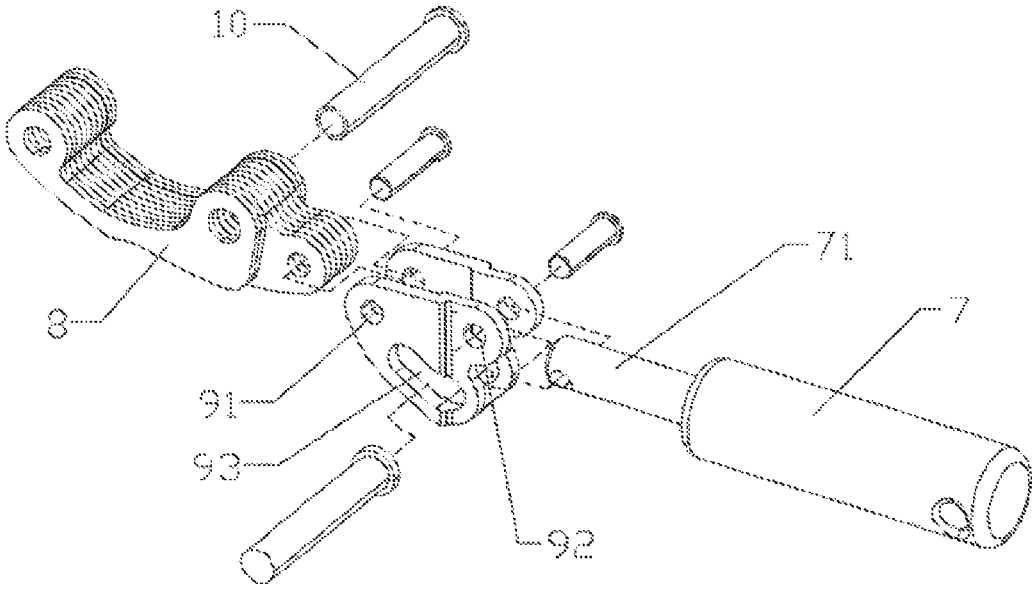
FIG. 6 is an exploded view of a hinge arm module with a damper in an embodiment of the present disclosure.

The swinging arm connecting hole, 91, is positioned on one side of the base connecting hole, 93, and the damper connecting hole, 92, is positioned on the other or opposite side of the base connecting hole, 93. That arrangement allows the movable swinging arm, 9, to pivotly swing about the pin traversing the base connecting hole, 93. The base connecting hole, 93, can have the shape of an ellipse, as shown in FIG. 6, or the base connecting hole, 93, can also be a slotted hole to enable a direct movement along the axis of the hinge base.

As a further modification to the above embodiment, said swinging arm connecting hole, 91, said base connecting hole, 93, and said damper connecting hole, 92, can be arranged to represent the vertices of an inverted triangle with the base superior or above. Both the swinging arm connecting hole, 91, and the damper connecting hole, 92, can be above the base connecting hole, 93, allowing movable swinging arm, 9, to have a certain movement range with respect to a pin used to connect the movable swinging arm to the hinge base so as to ensure that the damper, 7, actuates horizontally only and will not receive or be expected to receive any perpendicularly applied forces. Alternatively, the swinging arm connecting hole, 91, base connecting hole, 93, and damper connecting hole, 92, can be arranged substantially in line. That arrangement can effectively reduce the volume, area and size of the movable swinging arm, 9, and the damper, 7, from moving vertically.

The present disclosure modifies a conventional hinge arm with a sector gear transmission into one with a configuration comprising two swinging arms. That modification provides advantages, for example, the hinge cup, 1, can rotate flexibly and freely, extending lifespan. Moreover, the two swinging arms optimize the device by simplifying the structure of the hinge arm module and lowering the manufacturing cost to improve market competitiveness.

It will be appreciated that various changes and modifications can be made to the teachings herein without departing from the spirit and scope of the disclosure.

All references cited herein are herein incorporated by reference in entirety.

We claim:

1. A dampening hinge for furniture, comprising a hinge cup, a connecting arm and a hinge base, which are hinged together in sequence, wherein, said hinge cup comprises a U-shaped pin comprising an upper arm and a lower arm., one end of said connecting arm is attached to the upper arm of said U-shaped pin and the other end of said connecting arm is attached to said hinge base by a front bottom pin, a torsion spring is mounted on said hinge base by said front bottom pin, one free end of said torsion spring bears on the upper arm of said U-shaped pin and the other free end of said torsion spring bears on said hinge base, the lower arm of said U-shaped pin is attached to a pull rod of damper mounted on said hinge base by means of a hinge arm module, the opening and closing motion of the hinge cup relative to the hinge base is driven by an outer force, and wherein said hinge arm module comprises a swinging arm and a movable swinging arm, wherein, a portion of said swinging arm is attached to a pivot pin mounted on said hinge base, one end of said swinging arm is hinged with the lower arm of said U-shaped pin and the other end of said swinging arm is binged in a swinging arm connecting hole on said movable swinging arm, a damper connecting hole provided by said movable swinging arm connects said pull rod of said damper, said movable swinging arm is movably connected to a pin fixed on said hinge base by a base connecting hole thereof, said swinging arm connecting hole is positioned on one side of said base connecting hole, and said damper connecting hole is positioned on the other side of said base connecting hole, wherein said base connecting hole comprises a movable housing which enables said movable swinging arm to be movably connected to said hinge base.

2. The dampening hinge for furniture according to claim 1, wherein said swinging arm connecting hole, said base connecting hole and said damper connecting hole are configured in a triangle shape, in which said swinging arm connecting hole and said damper connecting hole are both above said base connecting hole.

3. The dampening hinge for furniture according to claim 2, wherein said movable housing of said base connecting hole has a shape of an ellipse.

4. The dampening hinge for furniture according to claim 2, wherein said movable housing of said base connecting hole is an elongated hole.

5. The dampening hinge for furniture according to claim 1, wherein said movable housing of said base connecting hole has a shape of an ellipse.

6. The dampening hinge for furniture according to claim 1, wherein said movable housing of said base connecting hole is an elongated hole.

7. The dampening hinge for furniture according to claim 1, wherein said movable swinging arm has a U-shaped configuration and connects the swinging arm and the pull rod of the damper.

8. The damping hinge for furniture according to claim 1, wherein said damper is an air damping cylinder or a hydraulic damping cylinder.

9. The dampening binge for furniture according to claim 1, wherein said swinging arm connecting hole, said base connecting hole and said damper connecting hole are configured in the same plane.

* * * * *